US012447573B2

(12) United States Patent
Zachariasen et al.

(10) Patent No.: US 12,447,573 B2
(45) Date of Patent: Oct. 21, 2025

(54) TOOL SHARPENER WITH CONCAVE SHARPENING SURFACE

(71) Applicant: Darex, LLC, Ashland, OR (US)

(72) Inventors: Joseph T. Zachariasen, Medford, OR (US); Travis Campbell, Medford, OR (US)

(73) Assignee: Darex, LLC, Ashland, OR (US)

( * ) Notice: Subject to any disclaimer, the term of this patent is extended or adjusted under 35 U.S.C. 154(b) by 768 days.

(21) Appl. No.: 17/544,525

(22) Filed: Dec. 7, 2021

(65) Prior Publication Data

US 2022/0088737 A1 Mar. 24, 2022

Related U.S. Application Data

(63) Continuation-in-part of application No. 15/929,718, filed on May 18, 2020, now Pat. No. 11,192,217.

(60) Provisional application No. 62/849,464, filed on May 17, 2019.

(51) Int. Cl.
*B24B 3/54* (2006.01)

(52) U.S. Cl.
CPC ..... *B24B 3/54* (2013.01)

(58) Field of Classification Search
None
See application file for complete search history.

(56) References Cited

U.S. PATENT DOCUMENTS 1,041,631 A 10/1912 Johnson
1,561,256 A 11/1925 Lilly
2,124,646 A 7/1938 Barsch
2,124,878 A 7/1938 Hammond
2,249,218 A 7/1941 Meade et al.
(Continued)

FOREIGN PATENT DOCUMENTS

CN 1049815 A 3/1991
CN 201544139 U * 8/2010
(Continued)

OTHER PUBLICATIONS

English translation of SE-1350999-A1, publication date: Mar. 1, 2015.*

(Continued)

*Primary Examiner* — Hwei-Siu C Payer
(74) *Attorney, Agent, or Firm* — Workman Nydegger

(57) ABSTRACT

Apparatus configured to sharpen a blade of a cutting tool. In some embodiments, a sharpener is provided having a housing and a sharpening stage with at least one sharpening element. Each sharpening element is characterized as a plate and has a curvilinearly extending, concave sharpening surface configured to impart a corresponding convex sharpening geometry to a selected side of the blade during a sharpening operation in which a user retracts the blade along a longitudinal drawing axis through the sharpening stage. A pair of intersecting sharpening elements may be provided to form a substantially v-shaped groove for a ripper-type sharpening stage. The sharpening element(s) may be fixed or tiltable with respect to the housing. The sharpening element(s) may further be moveable in a lateral direction to narrow or widen the v-shaped groove and change the convex geometry and edge angle imparted to the blade.

23 Claims, 8 Drawing Sheets

(56) References Cited

U.S. PATENT DOCUMENTS

| | | | | |
|---|---|---|---|---|
| 2,885,836 | A | 5/1959 | Robitaille | |
| 4,241,624 | A | 12/1980 | Rueggeberg | |
| 4,494,340 | A | 1/1985 | Carter | |
| 4,550,632 | A | 11/1985 | Inman | |
| 5,009,040 | A | 4/1991 | Petroff | |
| 5,458,534 | A | 10/1995 | Campione et al. | |
| 5,655,959 | A | 8/1997 | Juranitch | |
| 6,039,642 | A | 3/2000 | Collins | |
| 6,101,898 | A | 8/2000 | Gore et al. | |
| D469,326 | S | 1/2003 | Dahms | |
| 6,726,543 | B1 | 4/2004 | Klosterman | |
| 6,817,269 | B1 * | 11/2004 | Grace, Jr. | B24D 15/081 76/82 |
| 6,875,093 | B2 | 4/2005 | Friel et al. | |
| 7,172,500 | B1 | 2/2007 | Wu | |
| 8,221,199 | B2 | 7/2012 | Smith | |
| 8,591,291 | B2 | 11/2013 | Eklund | |
| 8,944,894 | B2 | 2/2015 | Smith et al. | |
| 9,216,487 | B1 | 12/2015 | Dovel | |
| 10,195,719 | B2 | 2/2019 | Vogel | |
| D860,752 | S | 9/2019 | Bloch | |
| D867,096 | S | 11/2019 | Chalfant et al. | |
| 10,850,361 | B1 * | 12/2020 | Dovel | B24D 15/081 |
| 11,192,217 | B2 * | 12/2021 | Zachariasen | B24D 15/081 |
| 2006/0211345 | A1 | 9/2006 | Levsen | |
| 2008/0171504 | A1 | 7/2008 | Smith | |
| 2010/0304646 | A1 | 12/2010 | Lytinas | |
| 2012/0180602 | A1 | 7/2012 | Murphy et al. | |
| 2014/0120812 | A1 | 5/2014 | Smith et al. | |
| 2015/0093976 | A1 | 4/2015 | Foster | |
| 2015/0283678 | A1 | 10/2015 | Hangen et al. | |
| 2016/0207171 | A1 | 7/2016 | Weiner et al. | |
| 2017/0361413 | A1 * | 12/2017 | Dovel | B24B 23/06 |
| 2020/0361061 | A1 | 11/2020 | Zachariasen | |
| 2022/0088737 | A1 * | 3/2022 | Zachariasen | B24B 3/54 |

FOREIGN PATENT DOCUMENTS

| | | | | |
|---|---|---|---|---|
| CN | 103921221 | A | 7/2014 | |
| CN | 107206576 | A | 9/2017 | |
| EP | 415604 | A * | 3/1991 | B24D 15/084 |
| GB | 0500678 | A | 2/1939 | |
| GB | 0517242 | A | 1/1940 | |
| SE | 1350999 | A1 * | 3/2015 | B24B 3/36 |

OTHER PUBLICATIONS

English translation of CN-201544139-U, dated Aug. 11, 2010.*

European Search Report received for EP Patent Application No. 20810482.8, mailed on May 3, 2023, 9 pages.

Office Action received for Chinese Patent Application No. 202080048747.8, mailed on Apr. 15, 2023, 26 pages (15 pages of English Translation and 11 pages of Original Document).

Office Action received for Vietnamese Patent Application No. 1-2021-07985, mailed on Dec. 13, 2023, 3 pages (1 page of English Translation and 2 pages of Original Document).

* cited by examiner

TOOL SHARPENER WITH CONCAVE SHARPENING SURFACE

RELATED APPLICATIONS

The present application is a continuation-in-part of U.S. patent application Ser. No. 15/929,718, now issued as U.S. Pat. No. 11,192,217, which in turn makes a claim of domestic priority to U.S. Provisional Patent Application No. 62/849,464. Both of these documents are hereby incorporated by reference.

BACKGROUND

Cutting tools are used in a variety of applications to cut or otherwise remove material from a workpiece. A variety of cutting tools are well known in the art, including but not limited to knives, scissors, shears, blades, chisels, machetes, saws, drill bits, etc.

A cutting tool often has one or more laterally extending, straight or curvilinear cutting edges along which pressure is applied to make a cut. The cutting edge is often defined along the intersection of opposing surfaces (bevels) that intersect along a line that lies along the cutting edge.

In some cutting tools, such as many types of conventional kitchen knives, the opposing surfaces are generally symmetric; other cutting tools, such as many types of scissors and chisels, have a first opposing surface that extends in a substantially normal direction, and a second opposing surface that is skewed with respect to the first surface.

Complex blade geometries can be used, such as multiple sets of bevels at different respective angles that taper to the cutting edge. Scallops or other discontinuous features can also be provided along the cutting edge, such as in the case of serrated knives.

Cutting tools can become dull over time after extended use, and thus it can be desirable to subject a dulled cutting tool to a sharpening operation to restore the cutting edge to a greater level of sharpness. A variety of sharpening techniques are known in the art, including the use of grinding wheels, whet stones, abrasive cloths, abrasive belts, abrasive rods, flexible discs, etc.

SUMMARY

Various embodiments of the present disclosure are generally directed to an apparatus configured to sharpen a cutting tool.

In some embodiments, a sharpener is provided for sharpening a cutting tool having a blade. The sharpener includes a housing, and a sharpening stage with at least one sharpening element. The sharpening element is characterized as a plate and has a curvilinearly extending, concave sharpening surface configured to impart a corresponding convex sharpening geometry to a selected side of the blade during a sharpening operation in which a user retracts the blade along a longitudinal drawing axis through the sharpening stage.

In related embodiments, a sharpener has a housing and a sharpening stage adapted to facilitate a sharpening operation upon a cutting tool responsive to retraction, by a user, of a blade of the tool along a longitudinal drawing axis. The sharpening stage has a first sharpening element with a first curvilinearly extending, concave sharpening surface, and a second sharpening element with a second curvilinearly extending, concave sharpening surface. The second sharpening element intersects the first sharpening element to form a substantially v-shaped groove between the first and second curvilinearly extending, concave sharpening surfaces to impart a corresponding convex sharpening geometry to the blade.

These and other features and advantages of various embodiments can be understood from a review of the following detailed description in conjunction with the accompanying drawings.

DETAILED DESCRIPTION

Figure 1A:
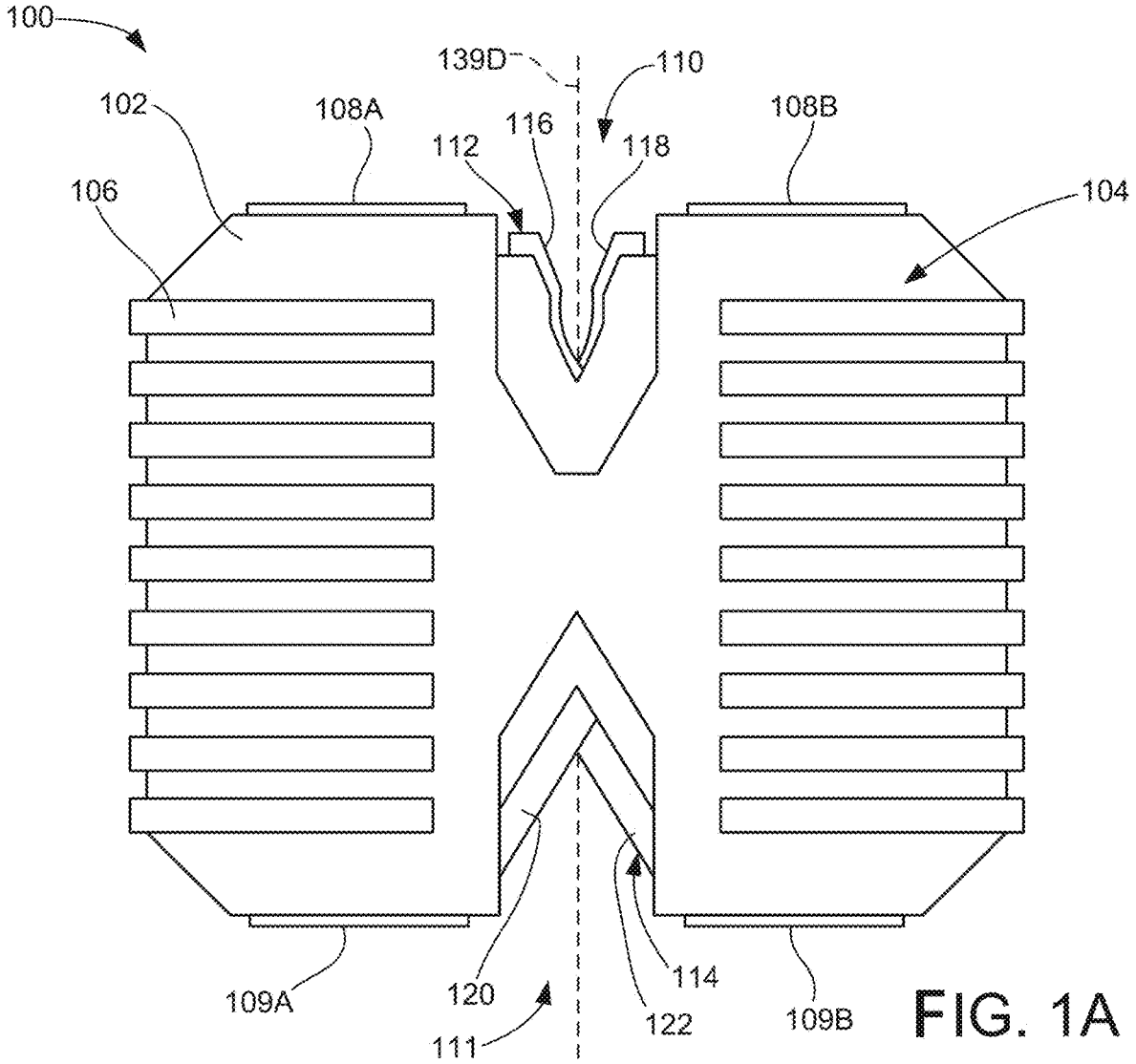
FIGS. 1A and 1B show front and top representations of a manual sharpener constructed and operated in accordance with various embodiments of the present disclosure.

Various embodiments of the present disclosure provide a sharpener for a cutting tool to sharpen a cutting edge thereof, and a method of sharpening the same. The sharpener is adapted to sharpen any number of cutting tool configurations, including but not limited to kitchen knives, pocket knives, etc.

Some embodiments provide a sharpener with a main body (housing) and a tiltable (rotatable) sharpening mechanism housed within the main body. The tiltable sharpening mechanism includes one or more sharpening members (elements) adapted to perform a sharpening operation upon a blade of a cutting tool drawn thereacross. Some embodiments utilize a pair of sharpening elements which intersect along a selected plane.

The sharpening element or elements may be supported by a central body of the tiltable sharpening mechanism. The central body is rotatable about a transverse rotational axis that is orthogonal to a longitudinal drawing axis along which the cutting tool is drawn during the sharpening operation; stated another way, the sharpening element or elements are adapted to rotate, or rock, in a front-to-back orientation with respect to the user as the user retracts the cutting tool against the sharpening element(s).

In some embodiments, the sharpening mechanism includes a single (first) abrasive element. In other embodiments, the sharpening mechanism includes intersecting first and second abrasive elements. The abrasive element(s) can take any number of desired configurations including carbide ripper elements, abrasive ceramic rods, steel elements, diamond or other coated elements, stones, wheels, discs, etc. The abrasive elements can take any suitable shape including linear or curvilinear sharpening surfaces. In some embodiments, the curvilinear surfaces of the abrasive elements are concave in shape in order to impart a convex grinding geometry to the cutting tool.

At least one biasing element, such as a spring, can be affixed to the sharpening mechanism to normally bias the sharpening mechanism, and the intersecting first and second abrasive elements, in a desired normal orientation with respect to a housing of the sharpener. In some embodiments, this orientation is characterized as a zero degree (0°) orientation. A locking mechanism is provided in some embodiments to maintain the first and second abrasive elements in this zero degree orientation. This zero degree orientation is also referred to as a locked neutral position. When the locking mechanism is in place, sharpening operations can be carried out upon the blade of the cutting tool with the first and second abrasive elements in the locked neutral position.

The locking mechanism is configured to selectively release the captured state of the sharpening mechanism so that, if the locking mechanism is in an unlocked state, the sharpening mechanism is free to rotate in response to the drawing of the blade of the cutting tool through the first and second abrasive elements. The total amount of rotation that the sharpening mechanism can undergo is a function of the construction of the sharpener.

In at least some embodiments, it is contemplated that the biasing force supplied by the biasing element will be responsive to the drawing of the blade, and the angle at which the sharpening element(s) engage the blade may change depending on the geometry of the cross section of the cutting tool (e.g., the knife). If the knife bevel geometry does not conform to the shape of the abrasive member, it is considered dull. If a knife is dull, the contact area between the abrasive surface and the knife bevel will be small. This small surface area increases the pressure applied to the knife, assuming the users downward force is constant.

As material continues to be removed from the knife over successive strokes (repetitive retractions of the knife against the sharpening element(s)), the bevel geometry will increasingly conform to the shape of the abrasive element(s), which will in turn reduce the pressure and consequently the amount of material removed from the knife. In this way, the biasing mechanism helps the user remove more material in areas of the knife that are dull, and less material in areas where the knife is sharp or more closely conforms to the contour of the abrasive element. Once the knife geometry nominally conforms to that of the abrasive element(s), the biasing mechanism will not engage with as much force as before, which can serve as a tactile indication to the user that the sharpening operation is completed, or it is time to move to another stage of sharpening to further hone the sharpness of the knife.

In some embodiments, the range of rotation of the sharpening mechanism is limited to an angular range of about nominally +/−15 degrees. When in the unlocked position, retraction of the blade will pull the sharpening elements toward the direction of retraction, enhancing the material removal process.

The locking mechanism can be configured to selectively lock or unlock the sharpening mechanism in the neutral position, a positive rake position (e.g., +15 degrees, etc. with respect to the vertical direction) and/or a negative rake position (e.g., −15 degrees, etc. with respect to the vertical direction). In further embodiments, the tilting mechanism can be respectively locked by the locking mechanism in each of the neutral, positive rake and negative rake positions as desired.

Configuring a sharpener to allow movement of the sharpening mechanism in both positive and negative angular directions will allow both right-handed users and left-handed users to keep the abrasive elements in a positive or negative rake angle depending on the user's perspective. Those skilled in the art will appreciate that some sharpeners of the current art provide fixed abrasive elements that are held in a positive, negative, or neutral rake position in reference to a face of the sharpener, but such sharpeners are limited in that they are most effective in only one orientation. The locking mechanism disclosed here adapts to any orientation, regardless of whether the user is right-handed or left-handed.

Further embodiments can incorporate an additional sharpening element such as in the form of a deployable cone-shaped abrasive rod. The cone-shape abrasive rod may be extendable from and retractable into the housing of the sharpener. The movement can be linear, rotatable, etc. The rod may take a number of configurations including ceramic, diamond coated, etc. Other shapes and styles of extendable and retractable sharpening elements can be used.

The main body (housing) of the sharpener can take a variety of shapes including symmetric, offset, etc. One or more user grip surfaces can be provided to enable a user to hold the sharpener with one hand while retracting the blade through the sharpening mechanism using the other hand. In further embodiments, the sharpener can be configured as a powered sharpener that provides motive power to advance a moveable abrasive member, such as a belt or a disc, adjacent the cutting edge of the tool to carry out a first type of sharpening operation. The powered sharpener can further be configured with a tilting sharpening mechanism to enable the user to carry out a different, second type of sharpening operation upon the tool.

While some embodiments provide concave sharpening elements in the tiltable sharpening mechanism, other embodiments provide a sharpening stage with concave sharpening elements that are stationary with respect to the main body of the sharpener. Hence, while various embodiments provide a sharpener with a tiltable sharpening mechanism, the presence of such tilting capabilities is advantageous but not required. Rather, further embodiments are contemplated that have intersecting sharpening elements with concave sharpening surfaces that do not nominally move with respect to the associated sharpening body.

Figure 1B:
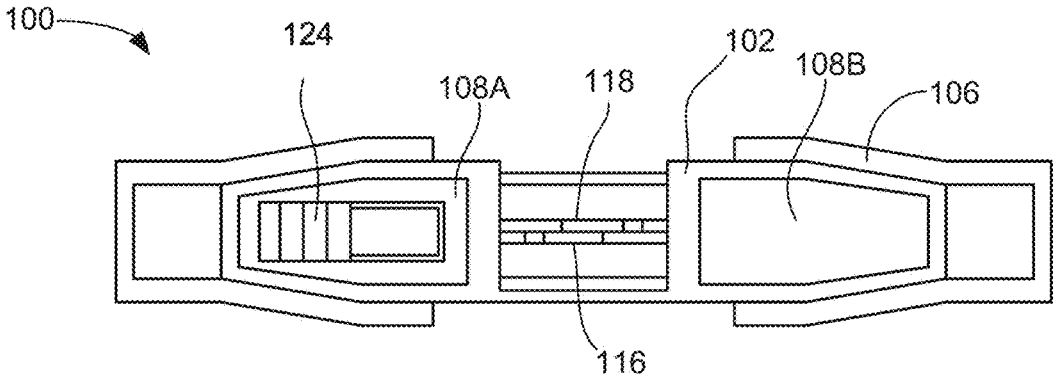

These and other features and advantages of various embodiments can be understood beginning with a review of FIGS. 1A and 1B which show side elevational and top plan views of a manual sharpener 100. The sharpener 100 is a hand-held sharpener configured to be held in the grasp of a user's hand, or to be steadied upright on a base surface, during a sharpening operation upon a cutting tool.

The sharpener includes a rigid housing 102 with a contoured outer grip surface 104 with a series of horizontal ridges 106. The ridges enhance the ability of the user to hold the sharpener in either the left or right hand. Other outer grip surface contours can be used as desired.

The top and bottom surfaces of the sharpener 100 include respective top elastomeric pads 108A, 108B and bottom elastomeric pads 109A, 109B to provide non-skip high friction surfaces to enable either the top or bottom of the sharpener to be placed on an underlying base surface in a secure manner during use.

The sharpener 100 is characterized as a so-called dual-ripper sharpener, so that the housing 102 is provided with a first sharpening stage 110 and a second sharpening stage 111. As explained below, the first sharpening stage 110 is characterized as a tiltable sharpening stage with a tiltable sharpening mechanism 112. The second sharpening stage 111 is characterized as a stationary sharpening stage with a stationary sharpening mechanism 114.

The tiltable sharpening mechanism 112 includes a first pair of intersecting sharpening elements 116, 118 that can be rotated forward and backwards with respect to the housing 102 about a transverse rotational axis over a selected angular range, such as +/−15 degrees. The stationary sharpening mechanism 114 is configured as a rigid mechanism so that a second pair of intersecting sharpening elements 120, 122 remain stationary with respect to the housing 102. As used herein, and consistent with the drawings, the term "intersecting" and the like will be understood to be intersecting, e.g., overlapping, a plane that includes an axis along which the cutting edge being sharpened is advanced.

The first elements 116, 118 take a substantially curvilinear configuration and the second elements 120, 122 take a substantially linear configuration, although other arrangements can be used as desired. The elements can take a variety of constructions including tungsten carbide rippers, ceramic rods or other elements, diamond coated elements, steel, etc. Generally, each pair of elements intersect to provide a substantially v-shaped slot with a desired geometry that is generally imparted to the sides of a blade adjacent a cutting edge as the blade is drawn therethrough.

A user-selectable switch 124 is shown to extend along the top left hand side of the sharpener 100 as shown in FIG. 1B. The switch is recessed within the associated pad 108A and can be slid back and forth to lock and unlock the first sharpening mechanism 112, and hence allow or impede angular rotation thereof.

Figure 2A:
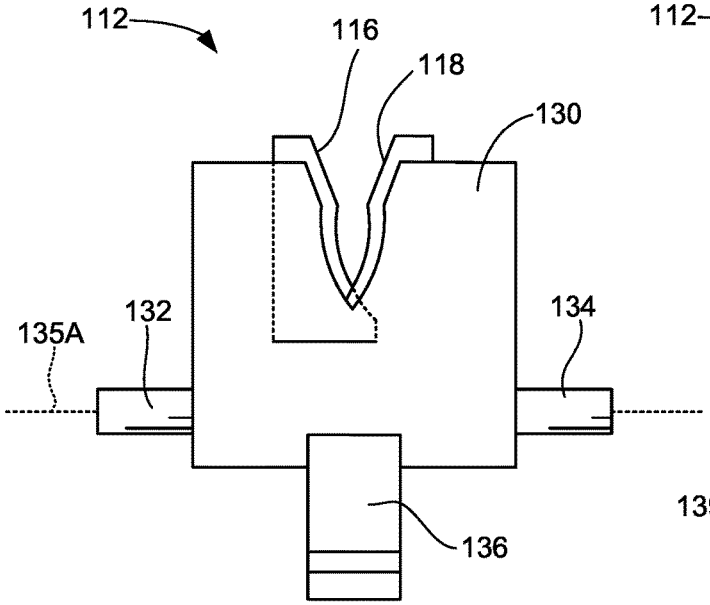
FIGS. 2A and 2B show side front and elevational sides of a tiltable mechanism of the manual sharpener of FIGS. 1A and 1B.
Figure 2B:
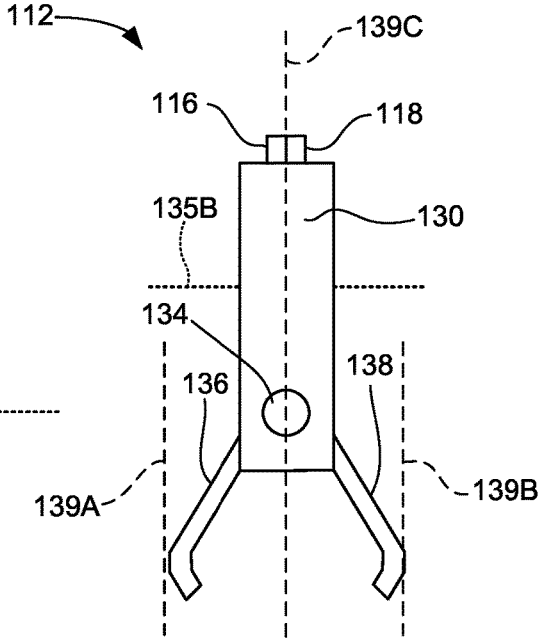

FIGS. 2A and 2B show the tiltable sharpening mechanism 112 of the first sharpening stage 110 in some embodiments. The mechanism 112 includes a rigid body 130 that houses the respective sharpening elements 116, 118. The body 130 is configured to rotate within the housing 102 of the sharpener 100 about a pair of opposing cylindrical shafts 132, 134 which project from opposing sides of the body 130 as shown. The shafts 132, 134 are aligned for rotation about a transverse rotational axis 135A (see FIG. 2A). The transverse rotational axis 135A is nominally orthogonal to a longitudinal drawing axis 135B along which the cutting tool is retracted (drawn) between the sharpening elements 116, 118 during a sharpening operation (see FIG. 2B).

A pair of spring members 136, 138 extend from a lower end of the body 130. The spring members 136, 138 bear against interior wall surfaces 139A, 139B within the housing 102 of the sharpener. In this way, the spring members 136, 138 exert biasing forces that tend to center the sharpening mechanism 112 in an upright position, which corresponds to the aforementioned 0° position, also referred to as the neutral position. For reference, when the mechanism 112 is in the neutral position, a longitudinal axis of the mechanism 139C is nominally parallel to a corresponding longitudinal (e.g., vertical) axis 139D of the housing (see e.g., FIG. 1A). While biasing elements such as 136, 138 are contemplated, such are not necessarily required.

Figure 3A:
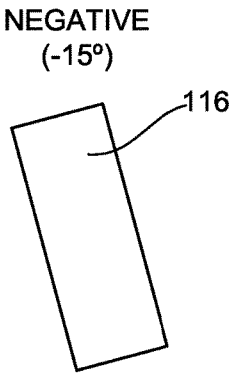
FIGS. 3A through 3C show different tilt angles accomplished by the mechanism of FIGS. 2A and 2B.
Figure 3B:
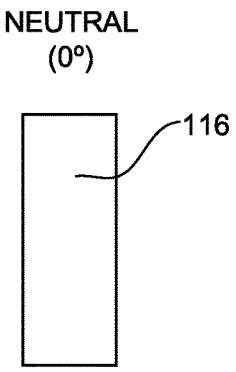
Figure 3C:
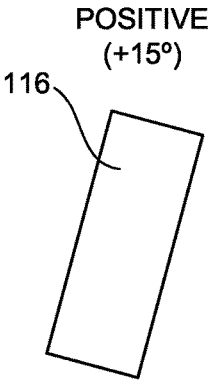

FIGS. 3A through 3C show different orientations of the sharpening mechanism 112 using the first sharpening element 116. It will be appreciated that the second sharpening element 118 concurrently undergoes similar changes in orientation. FIG. 3A shows a negative rake position in which the element 116 is pulled to the left (e.g., in a direction toward the user). FIG. 3B shows the neutral (0°) position, and FIG. 3C shows a positive rake position in which the element 116 is pulled to the right (e.g., oriented in a direction away from the user).

Figure 4A:
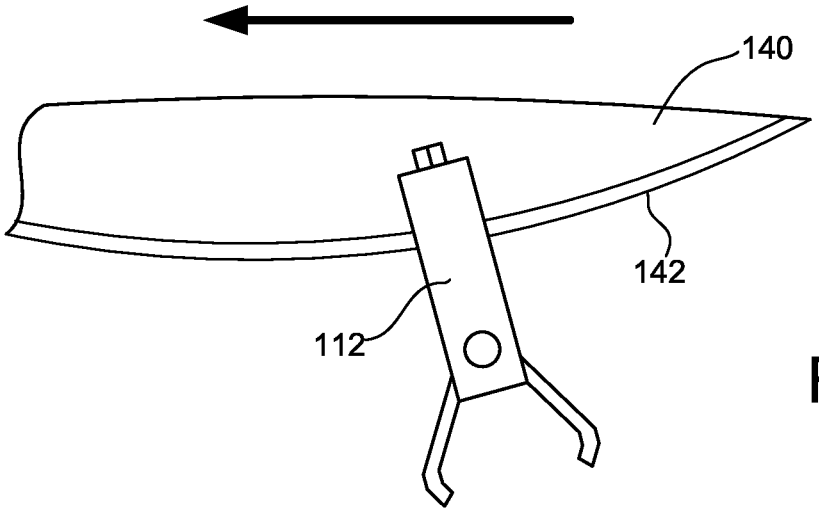
FIGS. 4A through 4C show different angles of the mechanism of FIGS. 2A and 2B in some embodiments.
Figure 4B:
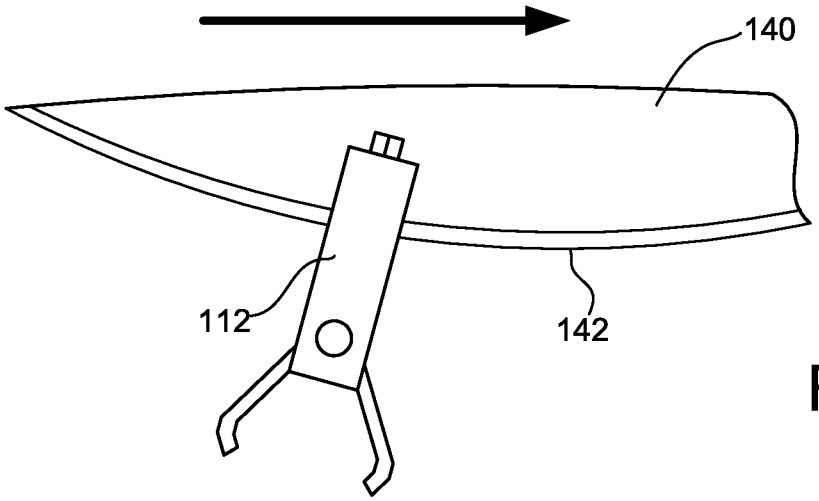
Figure 4C:
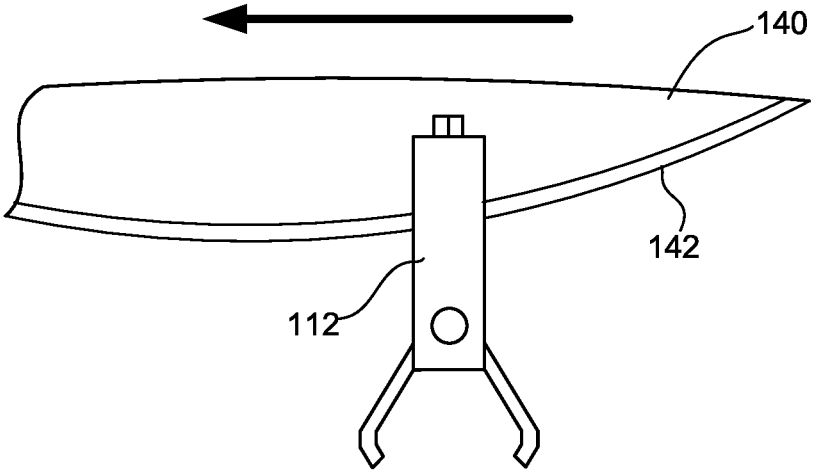

The respective negative and positive positions change the amount of rake, or chisel angle, that can be applied to the blade, thereby enhancing the sharpening efficiency of the elements. These respective angles are depicted in FIGS. 4A through 4C as a blade 140 with cutting edge 142 is respectively pulled through the elements 116, 118 of the sharpening mechanism 112. It can be seen that the sharpener can be used from either direction as required. The sharpening elements 116, 118 can be locked in each of the respective positive rake, neutral and negative rake positions as explained below.

Figure 5:
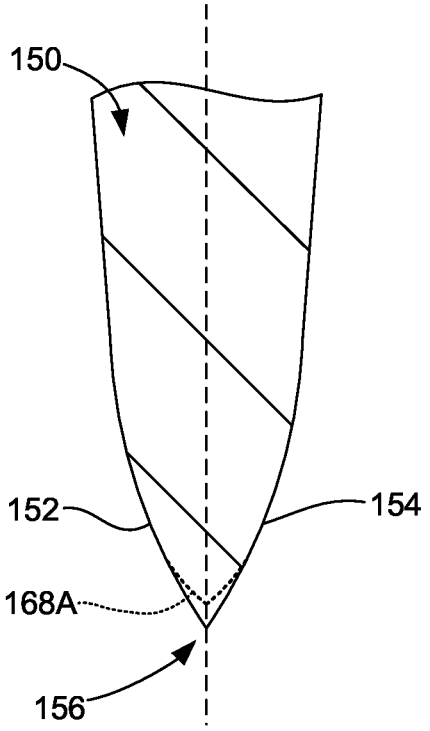
FIG. 5 shows a first sharpening geometry that can be achieved by the sharpener of FIG. 1.

FIG. 5 shows another blade 150 similar to the blade 140. The blade has a convex geometry with curvilinearly extending sides 152, 154 that converge to a cutting edge 156. The convex geometry is formed using the first sharpening mechanism 112, which has corresponding concave shaped curvilinear surfaces on the sharpening elements 116, 118 to generate the convex shape in FIG. 5.

Figure 6:
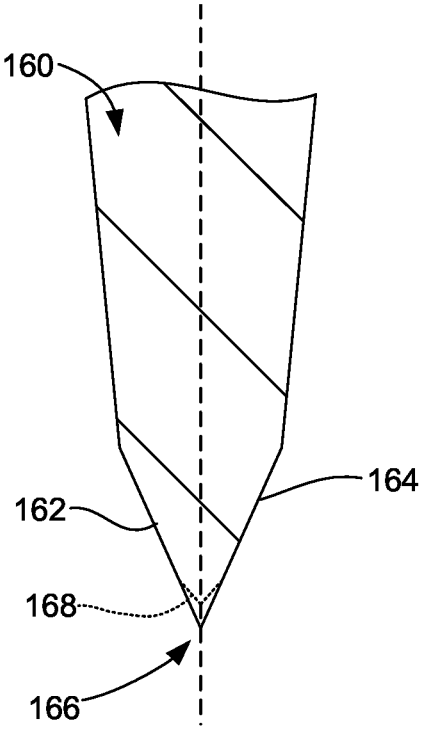
FIG. 6 shows a second sharpening geometry that can be achieved by the sharpener of FIG. 1.

FIG. 6 shows another blade 160. The blade has a linear tapered geometry with flat beveled sides 162, 164 that converge to a cutting edge 166. The linear geometry is formed using the second sharpening mechanism 114, although the linear geometry can also be generated using tiltable elements similar to the elements 116, 118 except with linear (e.g., straight line) sharpening edges.

Multiple sharpening operations can be carried out upon a given blade as desired. For example, a blade can be sharpened during a first sharpening operation using the first sharpening mechanism 112 to provide the general convex geometry of FIG. 5, followed by a second sharpening operation using the second sharpening mechanism 114 to apply a tapered geometry to lower portions of the sides of the blade (e.g., a microbevel) adjacent the cutting edge. In other examples, a blade can be sharpened initially using the first sharpening mechanism 112 in the rotatable state to provide enhanced rake and material take off rate, followed by locking the first sharpening mechanism 112 in the neutral position (or some other position) to provide microbeveling and honing of the cutting edge.

An example microbevel is represented at 168 for the tapered geometry blade 160 in FIG. 6. Similar microbevels can be applied to the convex geometry blade 150 in FIG. 5, such as denoted at 168A. Other combinations of the various stages can be used as desired.

Figure 7:
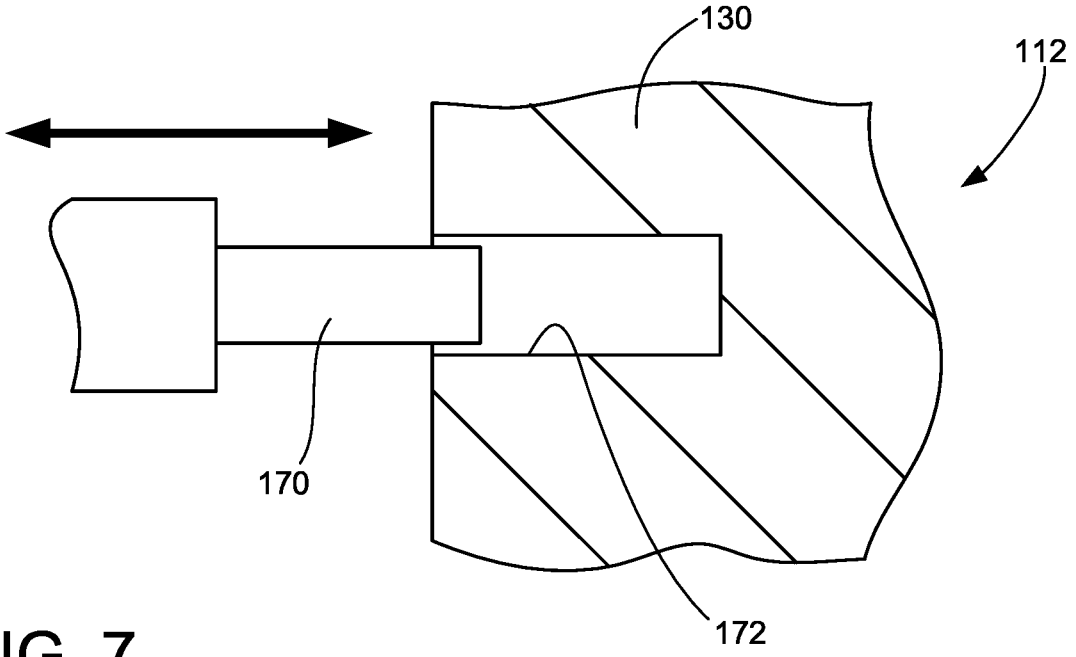
FIG. 7 shows a locking mechanism that can be used with the sharpener of FIG. 1 in some embodiments.

FIG. 7 shows a locking pin 170 adapted to slidingly engage a central locking aperture 172 in the body 130 of the first sharpening mechanism 112. The pin 170 is advanced or retracted using the user selectable switch 124 in FIG. 1B to place the mechanism in the locked or unlocked state. In some embodiments, the pin 170 can be configured to be inserted into the aperture 172 to lock the sharpening mechanism 112 in the neutral position.

The pin 170 can further be extended to one side of the main body of the sharpening mechanism to lock the sharpening mechanism in the positive rake position, and can be extended to the other side of the main body of the sharpening mechanism to lock the sharpening mechanism in the negative rake position. These respective options are denoted in FIGS. 8A through 8C, which show the sharpening mechanism 112 in respective neutral, negative rake and positive rake orientations, respectively.

Figure 8A:
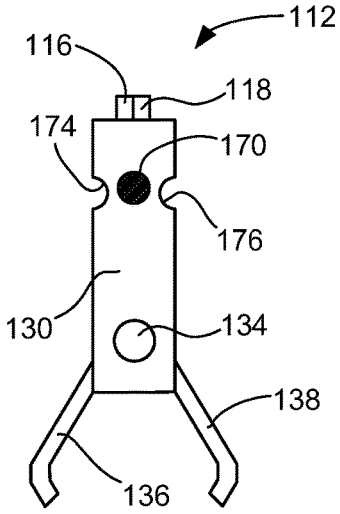
FIGS. 8A through 8C show the locking mechanism of FIG. 7 in accordance with further embodiments.
Figure 8B:
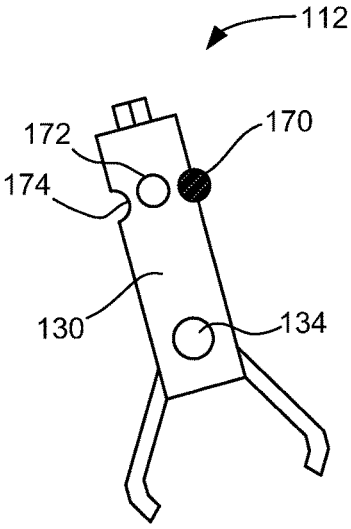
Figure 8C:
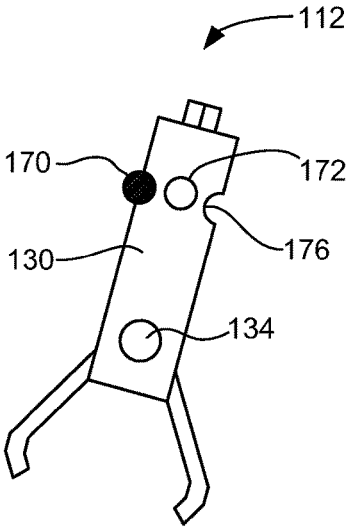

Curvilinearly extending detents 174, 176 can be provided on opposing sides of the central locking aperture 172 to partially receive the extendable and retractable locking pin 170 in the respective central aperture 172 (FIG. 8A), the right-side detent 176 (FIG. 8B) or the left-side detent 174 (FIG. 8C). The use of detents such as 174, 176 are contemplated but not required. As noted above, multi-stage sharpening can be carried out by sequentially locking the mechanism 112 in these respective positions.

For example, one sharpening sequence can involve a first, coarse sharpening operation with the mechanism 112 locked in the negative rack position of FIG. 8B; a second, intermediate sharpening operation with the mechanism 112 locked in the neutral position of FIG. 8A; and a third, fine sharpening operation with the mechanism locked in the positive rake position of FIG. 8C. Other sequences are readily contemplated and will immediately occur to the skilled artisan with the benefit of the present discussion.

Figure 9A:
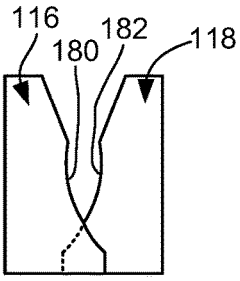
FIGS. 9A through 9D show alternative configurations for the sharpening elements of the tilting mechanism of FIGS. 2A and 2B.

FIGS. 9A through 9D show alternative configurations for the intersecting sharpening elements used in the tiltable sharpening mechanism 112. FIG. 9A shows the elements 116, 118 discussed above with curvilinearly extending sharpening surfaces 180, 182. The surfaces 180, 182 are characterized as concave surfaces to impart a convex sharpening geometry such as depicted in FIG. 5. While FIG. 9A shows the concave surfaces 180, 182 to be implemented in the tiltable sharpening mechanism 112, other arrangements can place the elements in a rigid orientation with respect to a sharpener housing, such as but not limited to the stationary sharpening stage 111 in FIG. 1A. In such case, a sharpener can be configured with concave surfaces to impart convex geometries such as in FIG. 5 without the need for a tiltable mechanism such as provided by the mechanism 112.

Figure 9B:
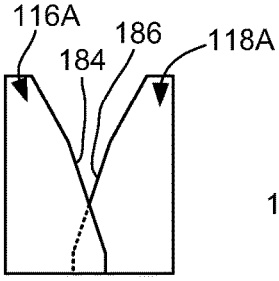

FIG. 9B shows similar sharpening elements 116A, 118A with linearly extending sharpening surfaces 184, 186. The straight surfaces 184, 186 impart a linear beveled geometry such as represented in FIG. 6. In the embodiments of FIGS. 9A and 9B, the respective sharpening elements 116, 116A, 118 and 118A can be metal plates or other members of a suitably hard and durable material.

Figure 9C:
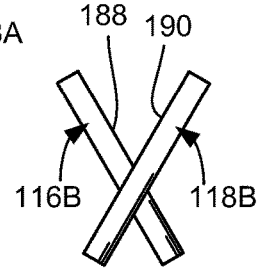

FIG. 9C shows another configuration with sharpening elements 116B, 118B characterized as cylindrical abrasive rods 188, 190. The rods 188, 190 intersect (cross) to form another v-shaped groove through which the blade can be drawn for a sharpening operation. The outer surfaces of the rods 188, 190 are nominally cylindrical (e.g., convex), and will tend to impart a linear beveled geometry as in FIG. 6. By adjusting the angles of the rod front-to-back as in FIGS. 8A-8C, different sharpening angles can be imparted to apply microbeveling to the cutting edge in a manner as discussed above.

Figure 9D:
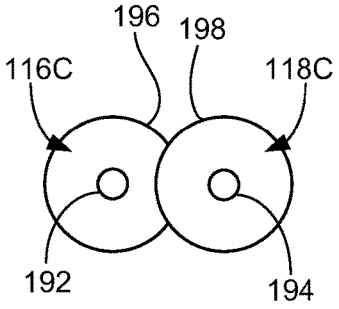

FIG. 9D shows yet another configuration in which sharpening elements 116C, 118C are arranged as interlocking disc shaped abrasive members (e.g., steel washers, etc.). The elements 116C, 118C are each respectively rotatable about central shaft members 192, 194 (e.g., threaded fasteners, etc.). The elements 116C, 118C have convex extending curvilinearly shaped sharpening surfaces 196, 198. In this case, the sharpening elements 116C, 118C are adapted to impart a concave (e.g., hollow grind) geometry to the cutting tool.

As before, the elements (discs) 116C, 118C are coupled to a central body portion that is rotatable about a transverse rotatable axis so that the axes about which the discs rotate (as established by shaft members 192, 194) are in turn rotatable about the transverse rotatable axis. Stated another way, the discs 116C, 118C can be pulled forward about the transverse rotational axis apart from the ability of the discs to be rotated about the rotational axes established by the members 192, 194 (which are generally parallel to the longitudinal drawing axis along which the cutting tool is drawn).

Figure 10:
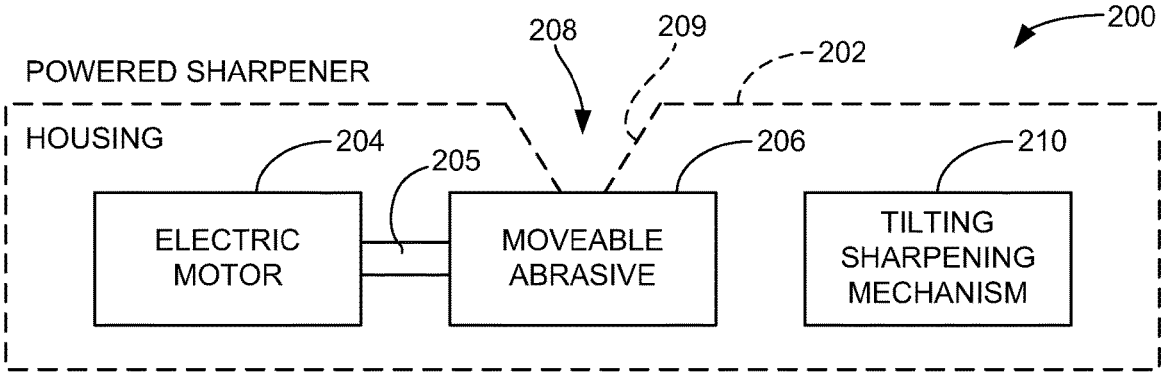
FIG. 10 is a functional block representation of a powered sharpener that incorporates a tiltable sharpening mechanism in accordance with further embodiments.

While the foregoing embodiments have contemplated the tilting mechanism to be incorporated into a manual sharpener, this is merely for purposes of illustration and is not limiting. FIG. 10 is a functional block representation of a powered sharpener 200 constructed and operated in accordance with further embodiments. The powered sharpener 200 includes a main housing 202 which encloses various elements of interest. The housing 202 may be adapted to be supported on a counter or other horizontal base surface during operation, or may incorporate a handle surface adapted to be gripped by a hand of the user to enable the powered sharpener to be used as a hand-held sharpener.

The sharpener 200 includes an electric motor 204 which is adapted to transfer rotational motive power, via a coupling 205 (e.g., a shaft, belt, gearbox, etc.), to a moveable abrasive 206 to advance the abrasive in a desired speed and direction. The motor 204 operates in response to application electrical power from a suitable power source, such as a wall socket, a battery, etc. The abrasive 206 can take any number of suitable forms such as an endless abrasive belt, a rigid grinding wheel, a flexible abrasive disc, etc.

One or more sharpening stages 208 are formed in the housing 202 to enable the user to present the cutting tool against the moveable abrasive 206 at a desired orientation in order to carry out a sharpening operation upon a cutting edge of the tool. The sharpening stage(s) 208 may include one or more support guide surfaces 209 to orient a side of the tool at the desired orientation against the abrasive 206.

The sharpener 200 further includes a tilting sharpening mechanism 210. The tilting sharpening mechanism 210 can take a general form such as the tilting mechanism 112, which has a pair of intersecting sharpening elements such as 116/118, 116A/118A, 116B/118B, 116C/118C, 120/122, etc. The mechanism 210 can provide the user with the option of a number of manual sharpening configurations to augment the sharpening available via the moveable abrasive 206.

In similar fashion, the powered sharpener can include a stationary sharpening stage with curvilinearly extending elements with concave sharpening surfaces, as represented in FIG. 9A, which are secured for non-rotation with respect to the housing 202 to augment the sharpening supplied by the moveable abrasive 206. These and other alternatives are readily contemplated. The angle of the tilting sharpening mechanism 210 (or the alternative stationary mechanism) can be selected to cooperate with the angle imparted by the guide surface(s) 209 to provide a final desired geometry to the cutting tool.

Figure 11A:
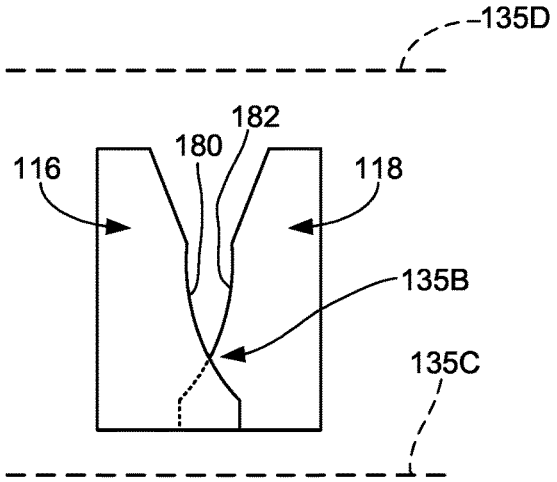
FIGS. 11A and 11B show further configurations of a sharpening mechanism in some embodiments.
Figure 11B:
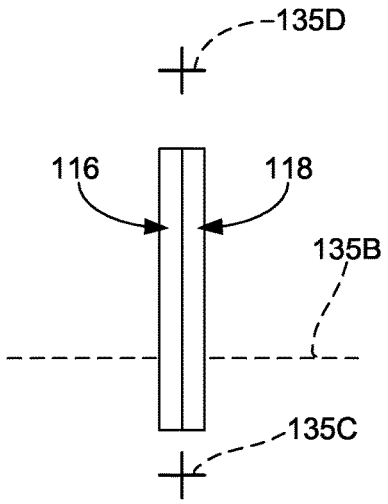

FIGS. 11A and 11B show features of another tiltable sharpening mechanism, numerically denoted with the general reference numeral 210A. The tiltable sharpening mechanism 210A can be incorporated into a manual sharpener such as 100 or a powered sharpener such as 200 as desired. The sharpening mechanism 210A includes intersecting sharpening elements 116, 118 with curvilinear sharpening surfaces 180, 182 as described above. The sharpening elements 116, 118 are supported by a main body (not separately shown) that is rotatable about different transverse axes. One configuration for the main body locates the axis of rotation below the sharpening elements, as indicated by axis 135C. A different configuration for the main body locates the axis of rotation above the sharpening elements, as indicated by axis 135D.

It will be appreciated that if the axis of rotation is below the longitudinal drawing axis along which the blade of the cutting tool is drawn, such as represented by drawing axis 135B and rotational axis 135C, the frictional interaction between the cutting tool and the sharpening elements will tend to induce a negative rake position. Contrawise, if the axis of rotation is above the longitudinal axis, as represented by drawing axis 135B and rotational axis 135D, the frictional interaction will induce a positive rake position. While it is contemplated that the sharpening element(s) will be rotatable about a single axis, further embodiments can include selective orientations of the abrasive elements such that the sharpening element(s) can be rotated about both axes 135C and 135D through user selection.

Figure 12:
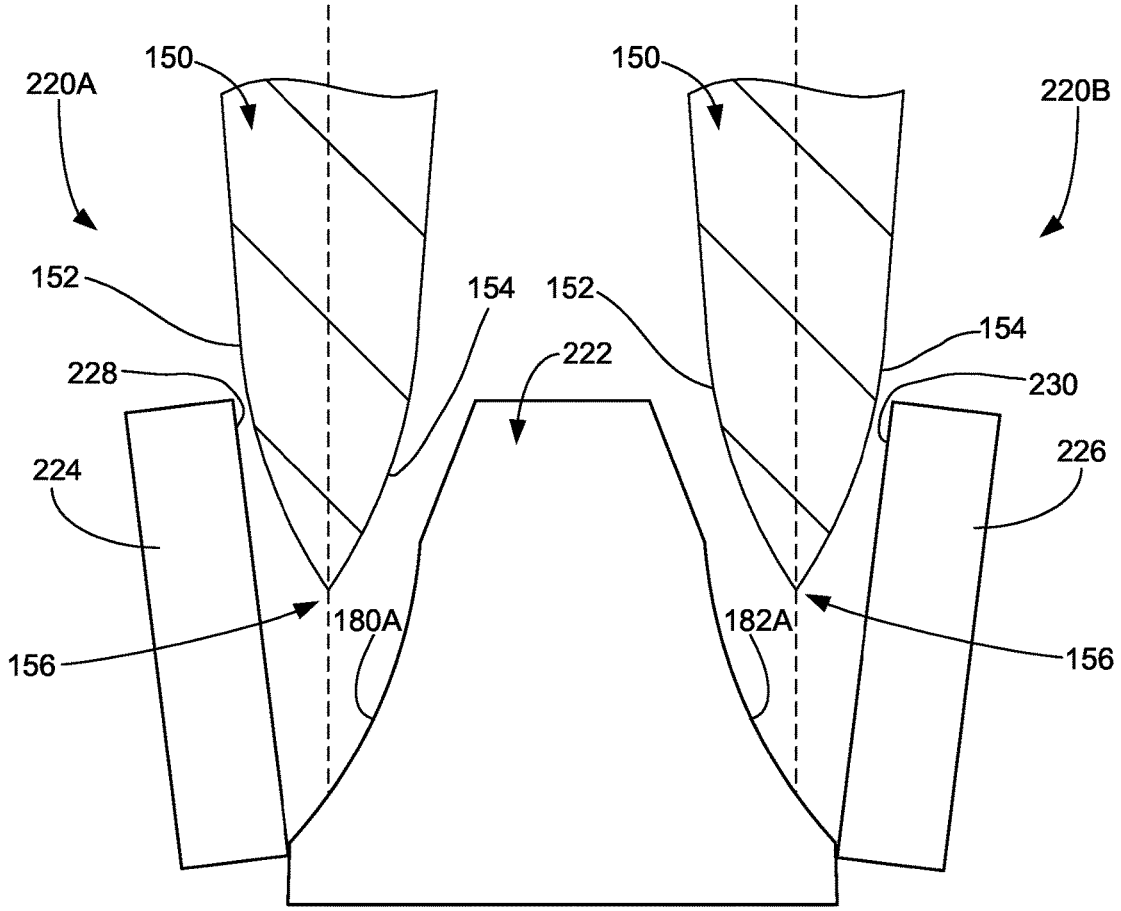
FIG. 12 shows yet another sharpening mechanism in some embodiments.

The various embodiments discussed thus far have contemplated the use of a pair of intersecting sharpening abrasive elements, such as the elements 116 and 118. This is merely for purposes of illustration and is not limiting. In yet further embodiments, a single sharpening element can be utilized, either in a tiltable or stationary orientation with respect to the main housing of the sharpener. To this end, FIG. 12 shows another sharpening system that incorporates two sharpening stages 220A and 22B adapted to sharpen opposing sides of a selected cutting tool. In the present example, the knife 150 from FIG. 5 has been illustrated, although other cutting tools and configurations can be used as desired.

In FIG. 12, the sharpening element 222 includes opposite curvilinearly (e.g., convex) extending sharpening surfaces 180A and 182B. The element 222 is rotatable about a selected transverse rotational axis, such as but not limited to the various axes 135A, 135C or 135D discussed above. In other embodiments, the element 222 is fixed to be stationary with respect to a surrounding housing (e.g., housings 102, 202, etc.).

The element 222 has a general bell shape and is bounded by guide elements 224 and 226, which are disposed in spaced apart relation adjacent opposing sides of the element 222. More particularly, the guide elements 224, 226 have inwardly facing guide surfaces 228, 230 which are in facing relation to the sharpening surfaces 180A, 182A as shown. The guide surfaces operate to maintain the tool 150 in a desired angular orientation as the user draws the tool against the respective sharpening surfaces. More particularly, guide surface 228 contactingly supports side surface 152 of the cutting tool 150 during sharpening of side surface 154, and guide surface 230 contactingly supports side surface 154 of the cutting tool 150 during sharpening of side surface 152.

In this way, the respective sharpening stages 220A and 220B provide separate sharpening stages against which opposing sides of the tool 150 are sharpened in alternating fashion. A user presents the tool 150 into a first stage, such as the stage 220A, and draws the tool therethrough a selected number of times, such as 3-5 times, to remove material and conform the blade to the corresponding shaping surface. The user then repeats this process using the remaining second stage, such as the stage 220B.

As before, the sharpening element 222 may be permitted to rotate freely (with or without the resistance supplied by a biasing element) or may be locked/fixed in place in any of a neutral, positive and/or negative rake position. While the sharpening element 222 is shown to be mirrored with dual sharpening surfaces 180A, 180B, in yet another embodiment a single sharpening stage and surface can be provided (e.g., such as in the left-hand side of FIG. 12), so that the user presents the cutting tool from opposite directions to enact the sharpening operation.

Figure 13A:
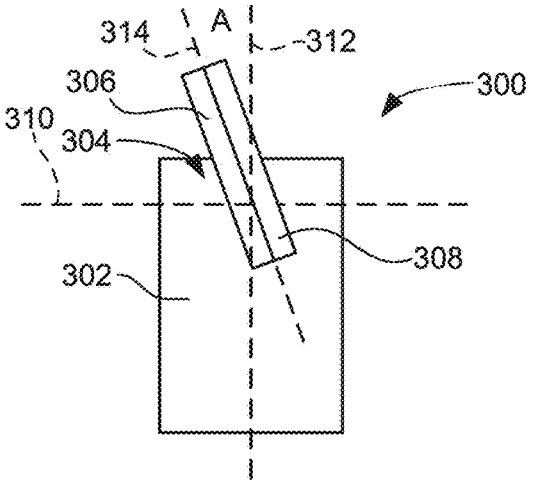
FIGS. 13A and 13B show another manual sharpener constructed and operated in accordance with further embodiments.

FIG. 13A shows another manual sharpener 300 in accordance with further embodiments. The sharpener 300, represented in simplified schematic fashion, includes a housing 302 with a sharpening stage 304. The housing 302 can be configured as discussed above to be held in the hand of a user, or can be placed on a support surface such as a counter top, etc. The sharpening stage 304 is adapted to permit a sharpening operation upon a cutting tool by drawing the tool through the stage.

The sharpening stage 304 includes a pair of intersecting, adjacent sharpening elements 306, 308. The elements take the form of plates of a suitable material, such as steel, tungsten carbide, ceramic, etc. While not necessarily required, it is contemplated that the elements have curvilinearly extending, concave sharpening surfaces such as depicted above in FIGS. 2A, 9A and 11A. The intersecting plates form an intervening slot or groove through which the cutting tool can be drawn along longitudinal drawing axis 310.

In some embodiments, the sharpening stage 304 is characterized as a stationary sharpening stage so that the elements 306, 308 are rigidly affixed and maintained in a non-moving relation with respect to the housing. The elements 306, 308 are angled at a reference angle A as defined by vertical central line 312 and bisecting central line 314. The angle A can be any suitable value and maintains the stage 304 in a fixed, negative position (see FIG. 3A) as the user draws the cutting tool to the left with respect to the orientation in FIG. 13A.

If the sharpening stage 304 is configured to be accessed by the user from both sides, the user can alternatively choose to draw the cutting tool to the right with respect to the orientation of FIG. 13A. In this case the elements 306, 308 are maintained in a fixed, positive position (see FIG. 3C) during such sharpening operation.

In an alternative embodiment, the sharpening stage 304 in FIG. 13A can be characterized as a tiltable sharpening stage so that the elements 306, 308 are permitted to move (e.g., rotate) with respect to the housing 302, such as via rotation about a suitable axis. A biasing mechanism can be used to nominally urge the elements 306, 308 to a baseline position, such as the neutral position discussed above (see e.g., FIG. 3B) or some other predetermined position.

Alternatively, no biasing mechanism is used and the elements 306, 308 are permitted to pivot in relation to the direction that the blade is passed through the stage 304. For example, if the elements 306, 308 are configured to freely pivot about a suitable pivot axis between defined limit stops, the operation of the user in contacting the tool against the sharpening surfaces and retracting the tool will tend to pull the elements toward the user, producing the orientation depicted in FIG. 13A.

Figure 13B:
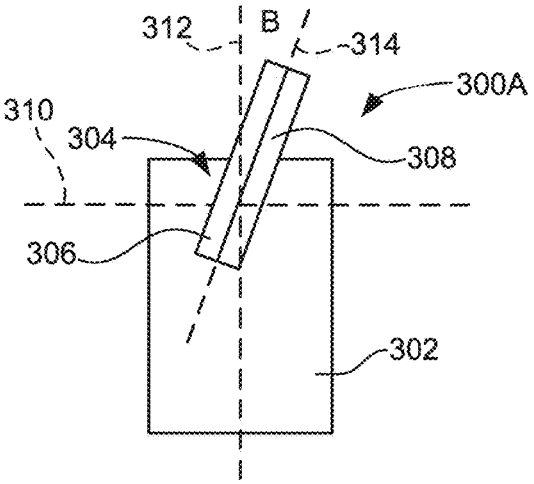

FIG. 13B shows another manual sharpener 300A similar to the sharpener 300 in FIG. 13A. In this case, the sharpening elements 306, 308 are fixed in a positive orientation as denoted by angle B between respective lines 312, 314 for a sharpening operation in which the cutting tool is drawn to the left. If angles A and B are identical and the stages in FIGS. 13A and 13B are bi-directional, then it will be noted that the sharpener 300A in FIG. 13B can be viewed as the opposite side of the sharpener 300 in FIG. 13A.

Figure 14A:
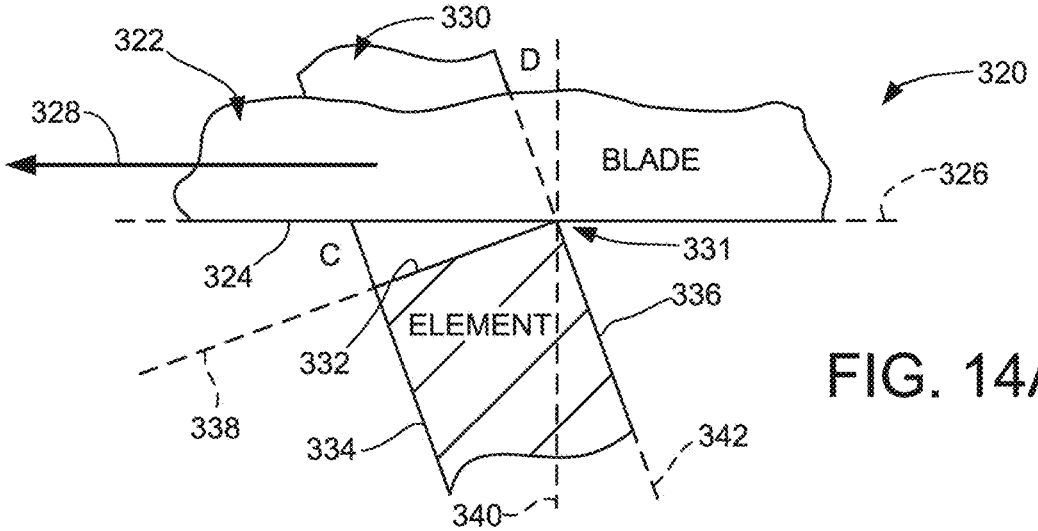
FIG. 14A is a schematic representation of a portion of the sharpener of FIGS. 13A-13B in some embodiments.

FIG. 14A shows aspects of another manual sharpener 320 similar to the sharpeners 300, 300A in FIGS. 13A-13B. The sharpener 320 depicts a blade 322 of a cutting tool (such as a kitchen knife) with a cutting edge 324 which is drawn along axis 326 in direction 328 during a sharpening operation.

The blade 322 is sharpened against a sharpening element 330 which is depicted in partial cross-section fashion. The sharpener 320 can use a single sharpening element 330 as shown, or two or more adjacent elements can be used as desired. The sharpening force is concentrated adjacent contact region 331.

The element 330 has a top relief surface 332, a front facing surface 334, and a rear facing surface 336. The top relief surface 332 is nominally orthogonal to the nominally parallel front and rear facing surfaces 334, 336, and extends at a relief angle C defined between lines 326 and 338. As such, the element 330 is arranged in a negative position as depicted in FIG. 13A. The relief angle C provides mechanical clearance for the cutting edge 324 to contactingly engage the element 330 adjacent the contact region 331, thereby enhancing the applied surface pressure and improving the efficacy of the sharpening operation.

Angle D can be characterized as the rake angle for the element 330, and extends between a vertical line 340 and an angled line 342 of the rear facing surface 336. As depicted in FIG. 14A, angle D is a small negative rake angle, although other rake angles can be used. As will be recognized, rake angle can influence a sharpening operation, including by providing clearance for any residue (cuttings, swarf, etc.) generated during the sharpening operation.

Figure 14B:
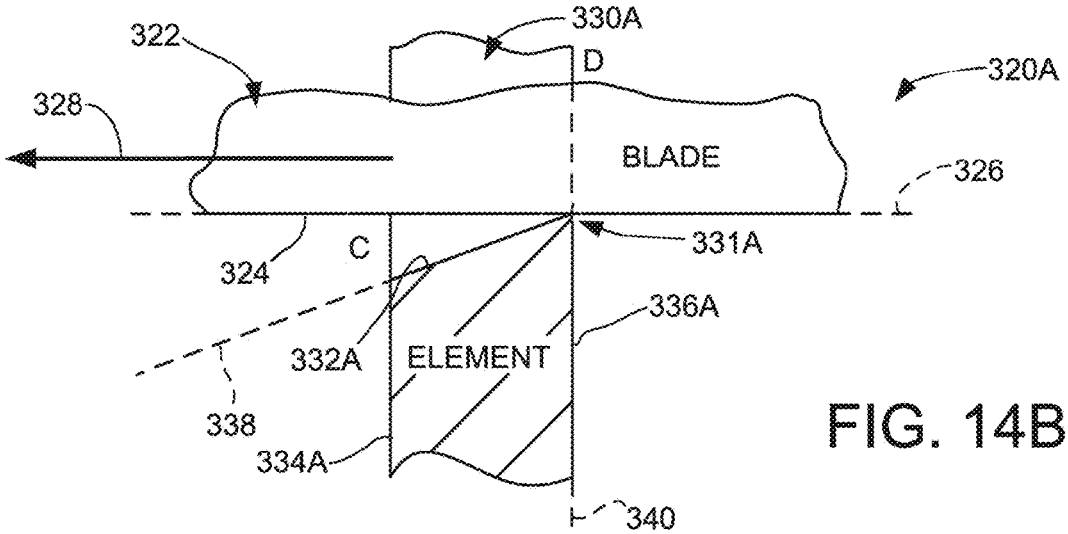
FIG. 14B is a schematic representation of another manual sharpener in some embodiments.

FIG. 14B presents aspects of a related manual sharpener 320A which is similar to the sharpener 320 in FIG. 14A, except as noted below. As before, the blade is drawn along direction 328 during a sharpening operation.

In FIG. 14B, a specially configured sharpening element 330A provides sharpening at contact region 331A, and has a relief surface 332A, a front facing surface 334A, and a rear facing surface 336A. The front and rear facing surfaces 334A and 336A are parallel as before, but the relief surface 332A is non-orthogonal (skewed) with respect to these other surfaces. This special configuration of the sharpening element can be provided in a variety of ways, such as via a secondary machining operation, etc.

The same relief angle C is provided between lines 326 and 338 as in FIG. 14A. A nominally zero (0) degree rake angle D is provided, which at least theoretically could provide enhanced surface pressure and sharpening efficiency over the configuration of FIG. 14A. The respective elements 330, 330A can be stationary or tiltable as desired.

Figure 15A:
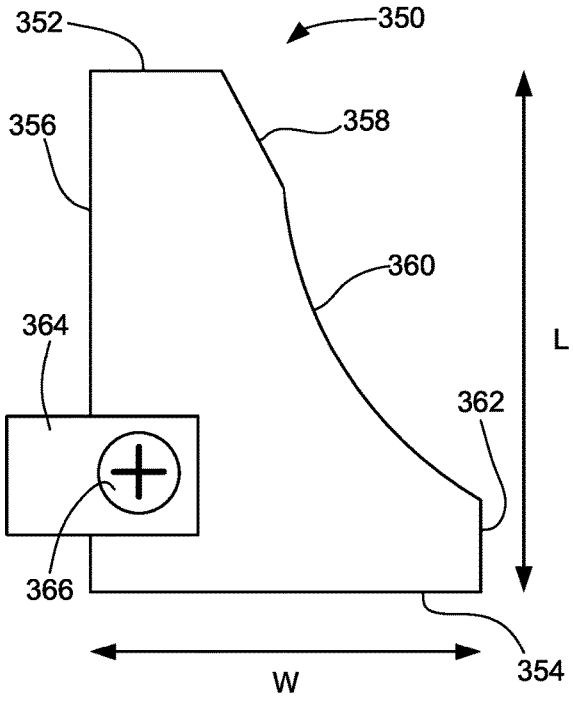
FIGS. 15A and 15B show respective elevational plan and side views of aspects of yet another manual sharpener in some embodiments.
Figure 15B:
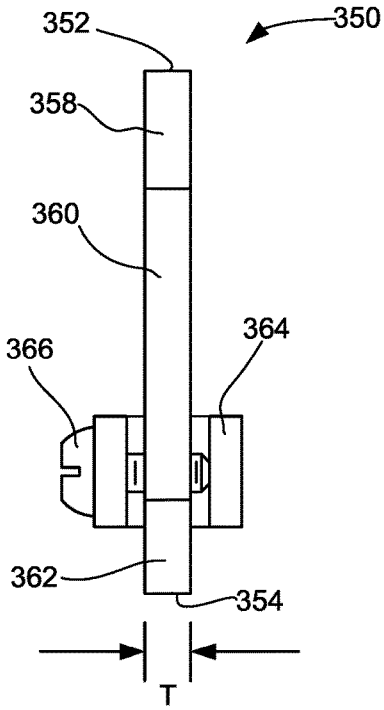

FIGS. 15A and 15B show elevational plan and side end views of a sharpening element 350 constructed and operated in accordance with further embodiments. The element 350 is suitable for installation and use in any of the various sharpeners discussed herein or other sharpeners that will occur to the skilled artisan in view of the present disclosure.

The element 350 is characterized as a plate of suitable material with respective length (L), width (W) and thickness (T) dimensions. For reference, the thicknesses T of the respective elements 330, 330A shown in FIGS. 14A-14B will generally correspond to the distances between the respective front and rear facing surfaces 334/336 and 334A/336A. Stated another way, the thickness T will generally lie along a plane (vertical in FIGS. 14A-14B) along which the longitudinal drawing axis (e.g., line 326) extends.

The relative dimensions for the length L, width W and thickness T can vary depending on the requirements of a given application. Nevertheless, because the element 350 is characterized as a plate, the thickness T will tend to be substantially smaller than the corresponding length L and width W. Without limitation, some embodiments provide a thickness T that is from about 10% to 25% of the length L and/or width W. Other respective values and ranges can be used.

The element 350 has a contoured outer perimeter with top surface 352, bottom surface 354, outside surface 356, and inside surfaces 358, 360 and 362. Other configurations can be used. The inside surface 360 is characterized as a curvilinearly extending, concave sharpening surface to impart a convex sharpening geometry to the cutting tool as discussed above. The remaining surfaces 352, 354, 356, 358 and 362 are shown to be linear (flat) surfaces, although such is not required.

The element 350 is contemplated as being removably replaceable, which can be useful in a number of circumstances such as to replace a worn or damaged element, to swap in an element with a different sharpening surface profile, etc. To this end, an attachment mechanism includes a bracket 364 and a set screw 366. In this configuration, the screw 366 extends through a corresponding feature (such as a through hole aperture) in the element and is engaged or disengaged as required to permit the plate to be installed or removed, respectively. Other attachment configurations can be used including but not limited to clamps, grooves, brackets, etc.

Figure 16A:
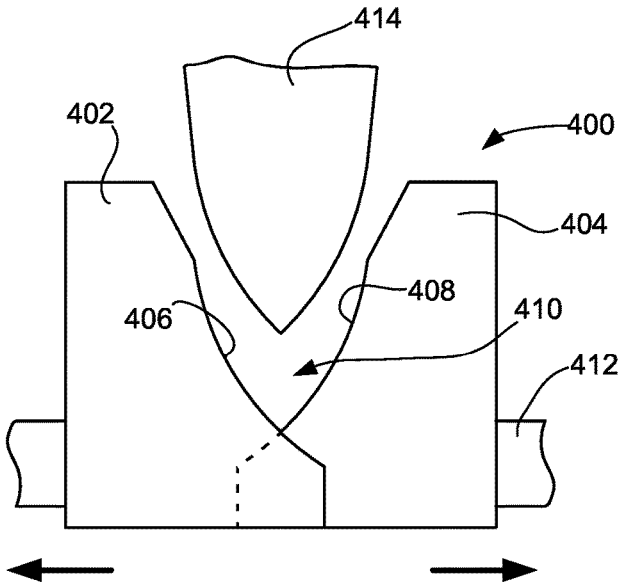
FIGS. 16A and 16B are depictions of aspects of still another manual sharpener in some embodiments.
Figure 16B:
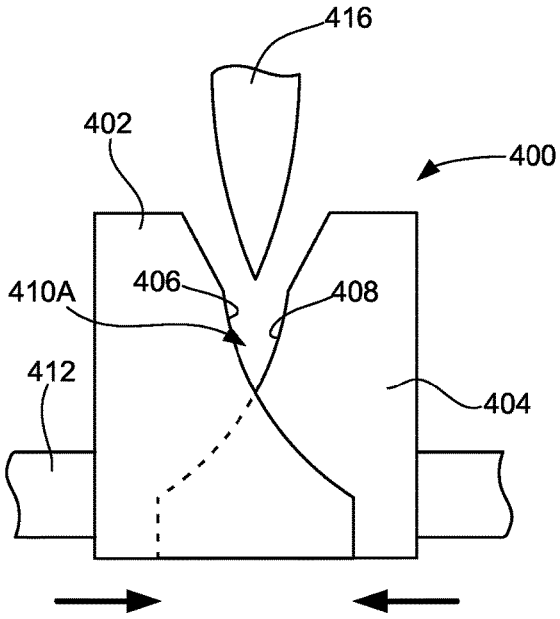

FIGS. 16A and 16B show aspects of yet another manual sharpener 400 in accordance with further embodiments. The sharpener 400 includes a pair of intersecting sharpening elements 402, 404, which may be plates similar to the element 350 in FIGS. 15A-15B. The elements 402, 404 have corresponding, inwardly directed, concave sharpening surfaces 406, 408 which cooperate to form a substantially v-shaped groove 410, 410A therebetween.

The elements 402, 404 are moveable with respect to one another via an adjustment mechanism 412, so that the plates can be moved farther apart as in FIG. 16A to accommodate sharpening of a wider tool 414, or can be moved closer together as in FIG. 16B to accommodate a narrower tool 416. The adjustment mechanism 412 is shown to impart movement in a lateral direction (as indicated by the associated arrows) to one or both of the plates using any suitable arrangement such as but not limited to a threaded worm drive, a rack and pinion drive, a spring biased clamp, etc. Other arrangements and movement profiles can be used, however, including pivotal movement, etc. In some cases, one of the plates can be maintained in a stationary position while the other plate is moved; in other cases, both plates can be configured to move.

It will be recognized that the relative movement of the elements 402, 404 selectively increases or decreases the overall intervening distance between the respective sharpening surfaces 406, 408, thereby providing a relatively wider groove 410 (FIG. 16A) or a relatively narrower groove 410A (FIG. 16B). Because the sharpening surfaces 406, 408 are concave, the grooves 410, 410A have different respective amounts of curvature, which impart different convex geometries to the tools 414, 416. These different convex geometries include different edge angles, which are the effective angles with respect to vertical adjacent the cutting edge; for example, tool 414 has an edge angle on the order of around 35 degrees, while tool 416 has an edge angle on the order of around 20 degrees.

In some embodiments, a particular groove can be adjusted to nominally match a sharpening geometry imparted by an associated sharpening process, such as a powered sharpening process as described above in FIG. 10. More particularly, use of a flexible moveable abrasive such as a flexible abrasive belt, a flexible abrasive disc, etc. can impart a desired convex geometry to a blade. In some cases, adjustments can be made to the system to produce different convex geometries (such as represented by the blades 414, 416). The adjustability of the system in FIGS. 16A-16B can thus enable the pull through ripper type sharpener to nominally match, or otherwise align with, the geometry provided by the powered sharpening process.

In one non-limiting example, a pull through ripper as embodied herein can be used to perform a first sharpening operation upon a given blade to provide a coarse level of sharpness and overall shaping to the blade. This can be carried out by repetitively drawing the blade adjacent one or more of the sharpener elements a suitable number of times, such as three (3) to ten (10) times, so that both sides of the blade are provided with an overall desired geometry. This can be particularly useful to address worn or damaged portions along the cutting edge of the blade.

A second sharpening operation can thereafter be applied to the blade to provide a fine level of sharpness such as during a honing process. This can be carried out in a number of ways, such as through the use of a powered sharpener, a honing element such as a ceramic rod or block, a second ripper type stage, etc. The secondary sharpening operation can nominally match the geometry supplied by the first sharpening operation, or can remove material adjacent the cutting edge to adjust the edge angle and provide a compound geometry such as depicted in FIG. 5. The sharpening elements disclosed herein can therefore be adapted for use in any number of different sharpening environments, including coarse, fine and honing operations as desired.

It will now be appreciated that the various embodiments presented herein provide a number of benefits over the existing sharpening art. A sharpening stage can be configured with at least one sharpening element having a curvilinearly extending, concave sharpening surface. The element can be stationary or tiltable. The sharpening stage can be used in a stand-alone fashion or in combination with other sharpening stages such as another manual stage or a powered stage.

In further embodiments, intersecting sharpening elements with concave sharpening surfaces can be provided to impart a convex geometry to both sides of a cutting tool blade. The elements can be affixed in neutral, positive or negative positions, and can be oriented to provide various relief and rake angles as required. The elements can be removable and replaced, either individually or as a module, and can further be advanced or retracted laterally to accommodate different sharpening geometries and edge angles.

It is to be understood that even though numerous characteristics and advantages of various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A sharpener for sharpening a cutting tool having a blade, the sharpener comprising:

a housing; and a sharpening stage comprising a sharpening element characterized as a plate and having a rear facing surface and a relief surface, the rear facing surface and the relief surface meet to form a first curvilinearly extending, concave sharpening contact region configured to impart a corresponding convex sharpening geometry to a selected side of the blade during a sharpening operation in which a user retracts the blade along a longitudinal drawing axis through the sharpening stage, the relief surface and the longitudinal drawing axis forming an acute relief angle.

2. The sharpener of claim 1, wherein the sharpening element is a first sharpening element, and the sharpening stage further comprises a second sharpening element having a second curvilinearly extending, concave sharpening contact region, the second sharpening element intersecting the first sharpening element to form a substantially v-shaped groove between the first curvilinearly extending, concave sharpening contact region and the second curvilinearly extending, concave sharpening contact region to impart the corresponding convex sharpening geometry to the blade.

3. The sharpener of claim 1, wherein the sharpening element is immovably fixed to the housing so that the sharpening stage is characterized as a stationary sharpening stage.

4. The sharpener of claim 3, wherein the sharpening element extends at a nonorthogonal angle with respect to the longitudinal drawing axis.

5. The sharpener of claim 1, wherein the sharpening element is rotatable with respect to the housing so that the sharpening stage is characterized as a tiltable sharpening stage.

6. The sharpener of claim 1, wherein the plate has respective length, width and thickness dimensions, the thickness dimension extending in a direction that lies along a plane along which the longitudinal drawing axis extends, the thickness dimension is 25% or less than either the length or width dimension.

7. The sharpener of claim 1, wherein the sharpening element is formed of at least a selected one of carbide, steel, diamond or ceramic.

8. The sharpener of claim 1, further comprising an attachment mechanism configured to releasably secure the sharpening element to the housing to allow the user to remove and reinstall the sharpening element as required.

9. The sharpener of claim 1, further comprising an adjustment mechanism that imparts movement of the sharpening element in a lateral direction orthogonal to the longitudinal drawing axis.

10. The sharpener of claim 1, wherein the sharpening element has a front facing surface, wherein the front and rear facing surfaces are nominally parallel, and wherein the relief surface extends between the front and rear facing surfaces at a nonorthogonal angle thereto.

11. The sharpener of claim 1, wherein the acute relief angle is established by tilting the sharpening element relative to the drawing axis.

12. The sharpener of claim 1, wherein the acute relief angle is established by the relief surface being formed at an acute angle relative to the rear facing surface.

13. A sharpener for sharpening a cutting tool having a blade, the sharpener comprising:

a housing; and a sharpening stage adapted to facilitate a sharpening operation upon the cutting tool responsive to retraction, by a user, of the blade along a longitudinal drawing axis, the sharpening stage comprising a first sharpening element having a first rear facing surface and a first relief surface, the first rear facing surface and the first relief surface meet to form a first curvilinearly extending, concave sharpening contact region, and a second sharpening element having a second rear facing surface and a second relief surface, the second rear facing surface and the second relief surface meet to form a second curvilinearly extending, concave sharpening contact region, the second sharpening element intersecting the first sharpening element to form a substantially v-shaped groove between the first and second curvilinearly extending, concave sharpening contact regions to impart a corresponding convex sharpening geometry to the blade during the sharpening operation in which the user retracts the blade along the longitudinal drawing axis through the sharpening stage, each of the relief surfaces and the longitudinal drawing axis forming an acute relief angle.

14. The sharpener of claim 13, wherein the sharpening stage is characterized as a stationary sharpening stage so that the first and second sharpening elements are maintained in a fixed, non-moving relation with respect to the housing.

15. The sharpener of claim 13, wherein the sharpening stage is characterized as a tiltable sharpening stage so that the first and second sharpening elements are rotatable with respect to the housing about a transverse rotational axis nominally orthogonal to the longitudinal drawing axis.

16. The sharpener of claim 13, wherein the first and second sharpening elements are each characterized as a plate having respective width, length and thickness dimensions, the thickness dimension being smaller than each of the respective width and length dimensions.

17. The sharpener of claim 16, wherein the thickness dimension is 25% or less of the smaller of the respective length or width dimension.

18. The sharpener of claim 13, wherein each of the first and second sharpening elements is formed of at least a selected one of carbide, steel, diamond or ceramic.

19. The sharpener of claim 13, wherein the first sharpening element is moveable with respect to the second sharpening element in a lateral direction to selectively increase or decrease an overall intervening distance between the first and second curvilinearly extending, concave sharpening contact regions to thereby widen or narrow the substantially v-shaped groove.

20. The sharpener of claim 13, wherein the first and second sharpening elements are secured to the housing at a non-orthogonal orientation with respect to the longitudinal drawing axis.

21. The sharpener of claim 13, wherein the first and second sharpening elements are secured to the housing so as to be in an orthogonal orientation with respect to the longitudinal drawing axis, and wherein the respective first and second relief surfaces are specially configured to extend in a non-orthogonal relation to opposing front and rear facing surfaces of the first and second sharpening elements.

22. The sharpener of claim 13, wherein the acute relief angle is established by tilting the first and second sharpening elements relative to the drawing axis.

23. The sharpener of claim 13, wherein the acute relief angles are established by the relief surfaces being formed at acute angles relative to the associated rear facing surfaces.

* * * * *